United States Patent [19]

Judy et al.

[11] 4,359,948

[45] Nov. 23, 1982

[54] KNOCK-DOWN PALLET AND STRINGER ATTACHING MECHANISM

[75] Inventors: Paul E. Judy; John A. Hoffman, both of Howell, Mich.

[73] Assignee: Paul Judy & Associates, Howell, Mich.

[21] Appl. No.: 137,842

[22] Filed: Apr. 7, 1980

[51] Int. Cl.[3] ..... B65D 19/32

[52] U.S. Cl. ..... 108/56.1; 52/820; 52/668; 108/901; 403/347

[58] Field of Search ..... 108/56.1, 56.3, 54.1, 108/51.1, 53.1, 55.1; 52/668, 820; 403/347, 346

[56] References Cited

U.S. PATENT DOCUMENTS

| | | | |
|---|---|---|---|
| D. 238,862 | 2/1976 | Hewson | D9/99 |
| 2,465,134 | 3/1949 | Toffolon . | |
| 3,003,055 | 10/1961 | Liberman | 52/668 X |
| 3,120,413 | 2/1964 | Scotti | 52/668 X |
| 3,126,843 | 3/1964 | Delaney | 108/52.1 |
| 3,287,874 | 11/1966 | Stahlhut | 52/668 X |
| 3,469,542 | 9/1969 | Ahlenins | 108/56.1 |
| 3,678,868 | 7/1972 | Hirota | 108/56.1 |
| 3,878,796 | 4/1975 | Morrison | 108/56.1 |
| 3,927,624 | 12/1975 | Hewson | 108/56.1 |

FOREIGN PATENT DOCUMENTS

| | | | |
|---|---|---|---|
| 2734044 | 2/1979 | Fed. Rep. of Germany | 52/668 |

*Primary Examiner*—William E. Lyddane

*Attorney, Agent, or Firm*—Arnold, White & Durkee

[57] ABSTRACT

A means for interconnecting stringers is disclosed. More particularly, a knock-down pallet constructed from a plurality of interconnected stringers is disclosed. The interconnecting means and knock-down pallet is particularly useful in providing a system whose individual stringers are easily attachable by hand without requiring the assistance of any tools.

14 Claims, 7 Drawing Figures

FIG. 1
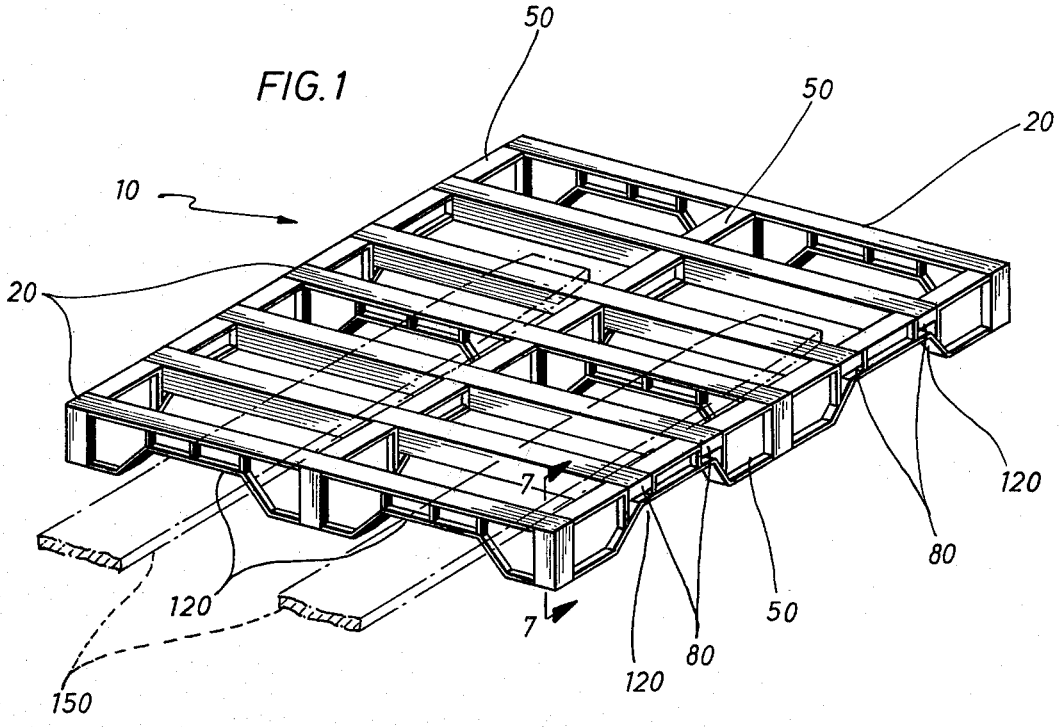
FIG. 5
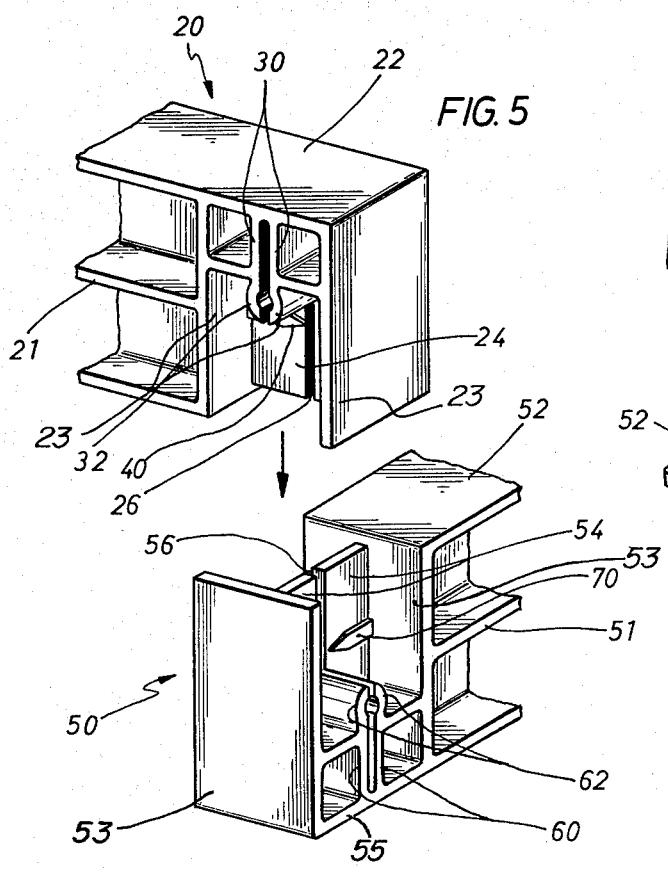
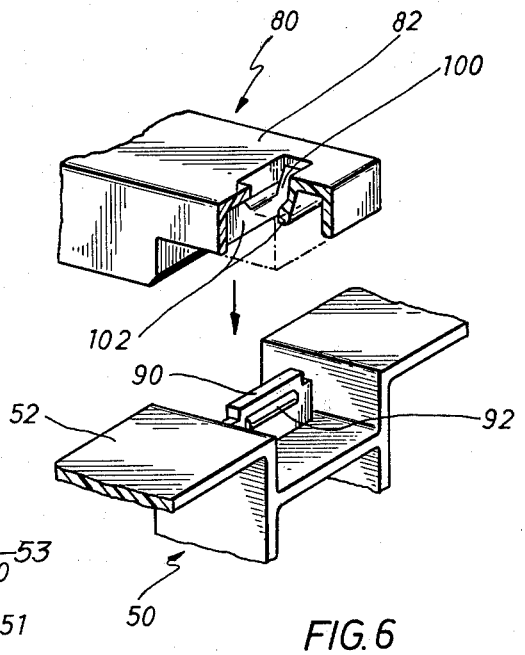
FIG. 6

KNOCK-DOWN PALLET AND STRINGER ATTACHING MECHANISM

BACKGROUND OF THE INVENTION

1. Field of the Invention

The invention relates to a means of interconnecting stringers, such as in the construction of a pallet. This interconnecting means is particularly useful in the construction of knock-down pallets.

2. Description of the Prior Art

The need exists for a strong, durable, inexpensive and easily constructed or repaired reusable pallet. In the past, pallets have been constructed for the most part of relatively heavy wooden stringers connected with relative lighter wooden slats nailed across the top and bottom of the stringers. These slats not only held the pallet together, but also provided the support surface. Wooden pallets so constructed are both expensive and fragile. They require expensive labor for assembly from increasingly expensive lumber. Further, such pallets are susceptible to easy breakage and damage when punctured by forklifts during normal usage. Repair of such pallets, again requiring expensive labor, is costly. Storage and transportation of empty pallets are also quite expensive since disassembly of such pallets is impracticable.

In an attempt to solve many of the problems listed above various knock-down pallets have been devised. The DeLaney pallet disclosed in U.S. Pat. No. 3,126,843 is an easily constructed pallet consisting of plastic stringers forming the basic elements with wooden strips giving additional rigidity and strength. Prior to initial construction the basic plastic stringers of the DeLaney pallet form a compact bundle.

Other pallets, such as that of Hirota, U.S. Pat. No. 3,678,868 and Morrison, U.S. Pat. No. 3,878,796, have been constructed using plastic or wooden slats shaped so as to fit within corresponding areas of three or more transverse stringers. The Ahlenius pallet described in U.S. Pat. No. 3,469,542 comprised merely a plurality of fitted and notched cross-attached stringers.

The pallet disclosed by Hewson in U.S. Pat. No. 3,927,624 is constructed by cross attaching a plurality of first notched stringers with a plurality of second notched stringers placed perpendicular to one another.

The above pallets solve some of the problems associated with standard wooden pallets. However, none of the pallets are able to overcome all of the difficulties associated with wooden pallets and yet not exhibit other problems. In particular, these pallets are plagued by weak corners.

Accordingly, prior to the development of the present invention, there has been no pallet which solves the problems and overcomes the disadvantages associated with the prior art pallets, whether permanently constructed of wood or knock-down plastic pallets. The pallet described by the present invention is able to solve these problems and overcome the associated disadvantages.

The art has long sought a pallet which was reusable, sturdy, durable, and inexpensively and easily constructed or repaired. As shown below, the pallet of the present invention meets this need.

SUMMARY OF THE INVENTION

The knock-down pallet of the present invention, which includes the means to interconnect stringers to form the basic elements of a pallet, overcomes many of the foregoing disadvantages and achieves the foregoing benefits. The present invention provides a pallet and means for constructing same by interconnecting stringers.

The present invention comprises a knock-down pallet constructed by interconnecting a plurality of parallel and appropriately spaced first stringers with a plurality of parallel and appropriately spaced second stringers placed perpendicular thereto. These stringers form the basic frame of the knock-down pallet. Additional strength and rigidity may be attained, in addition to a better defined support surface, by attaching slats across one set of stringers.

The stringers and additional support slats may all be interconnected by hand. No tools are required for the construction or repair of the knock-down pallet of the present invention. Thus, damaged or broken components may be easily and inexpensively replaced.

Pallets of varying sizes may also be constructed simply by interchanging the stringers along one direction for those of a different length. Thus a compact supply of stringers and slats of various sizes may be used to construct pallets of any needed size.

A principle feature of the invention is the means of interconnecting the stringers to form the basic pallet frame. This means includes the use of receiving slots placed in the top of the interconnecting members of a set of first stringers and corresponding receiving slots placed in the bottom of the interconnecting members of a set of second stringers. These slots permit the interconnection of the first stringers with the second stringers.

The present invention also provides a means of strengthening the joint where these stringers are attached. Guide and lock surfaces projecting perpendicular to the interconnecting member of each stringer and extending along at least one side of each receiving slot are provided. These guide and lock surfaces align parallel and adjacent to the interconnecting members of interconnecting stringer attached through the receiving slots. These guide surfaces help to stablize and strengthen the joints were stringers are attached by preventing lateral movement therein.

The invention further provides a means of locking such stringers in place. This means is provided by the addition of nipples or ridges along each stringer near each receiving slot. The guide surfaces contain corresponding indents or ridge gripping detents. When the stringers are placed together by interconnecting the receiving slots of the first stringers with those of the second stringers, the nipples and indents or ridges and ridge gripping detents of the two types of stringers snap together, locking the stringers in place.

This attaching and interconnecting means is not limited to use in the construction of pallets but may also be used to connect members for any purpose.

The pallet of the present invention, when compared with previously proposed prior art pallets, has the advantages of being reusable, durable, strong and sturdy as well as lightweight. It is also easily constructed, assembled, repaired or disassembled for compact storage and shipping. The present pallet has the further advantage of being constructed with an attaching means providing strong interconnecting corners. It is also believed that the pallet of this invention will last much longer than the standard wooden pallet. A pallet constructing according to the present invention provides great versatility in meeting the demands of the user.

BRIEF DESCRIPTION OF THE DRAWINGS

FIG. 1 is a perspective view of a pallet embodying the present invention.

FIG. 5 is a separated perspective view of the preferred embodiment of the interconnecting areas of one of the first and second stringers.

FIG. 6 is a separated, partially cut-away perspective view of the interconnecting areas of one of the second stringers with one of the slats.

Figure 2:
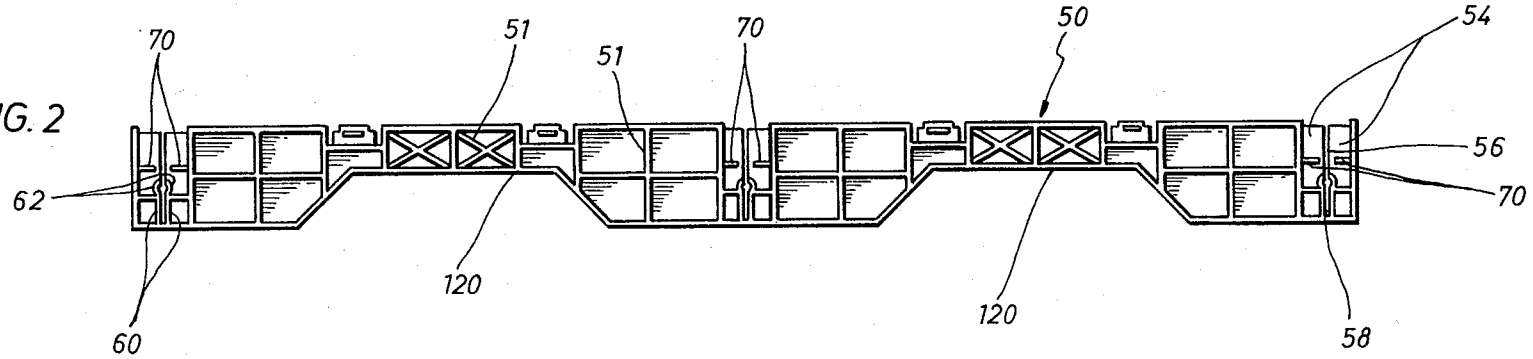
FIG. 2 is a side view of one of the second stringers of the pallet of FIG. 1.
Figure 3:
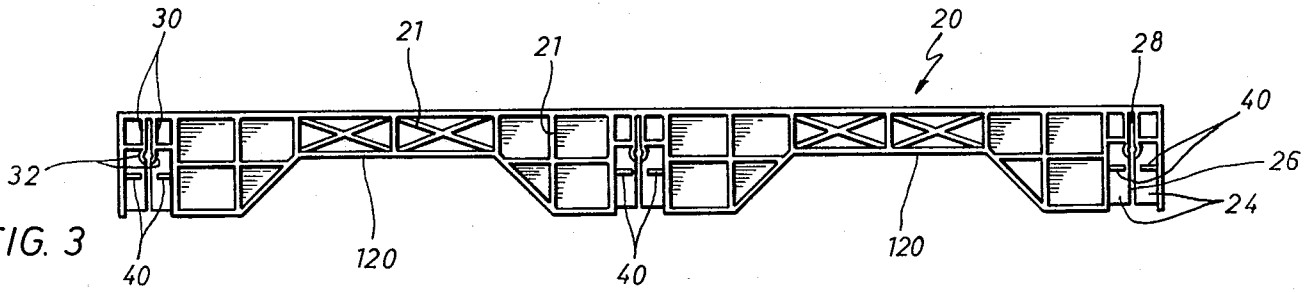
FIG. 3 is a side view of one of the first stringers of the pallet of FIG. 1.
Figure 4:
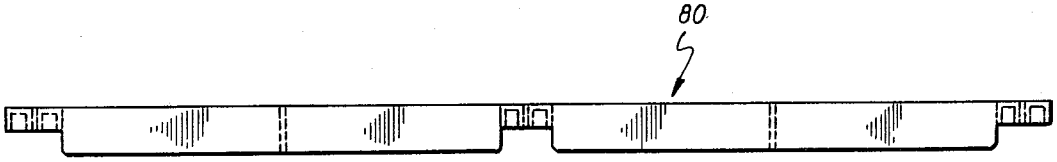
FIG. 4 is a side view of one of the slats of the pallet of FIG. 1.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

In the preferred embodiment of the invention the interconnecting means is in the construction of a frame for a knock-down pallet 10. A plurality of first stringers 20 is connected at right angles to a plurality of second stringers 50. In the preferred embodiment three first stringers 20 and three second stringers 50 are employed, all being constructed of polypropylene. However, these stringers may be constructed of any appropriate material with sufficient impact and tensile strength characteristics to minimize breakage.

The stringers of the preferred embodiment are constructed of polypropylene injection molded generally in an I-beam configuration. The upper surface of these stringers provides a support surface 22 and 52. The I-beam construction of these stringers is preferred for the strength yet lightweight characteristics which it provides. Additional strength may be provided by flange supports 21 and 51 extending along the sides of the stringers.

Appropriately spaced recesses 120 are provided in both sets of stringer to allow the insertion of the arms 150 of a forklift into or below the pallet. These recesses are preferably along the lower surfaces of stringers 20 and 50, as illustrated, but might also be provided as openings of appropriate size, shape and spacing placed through stringers 20 and 50.

Figure 7:
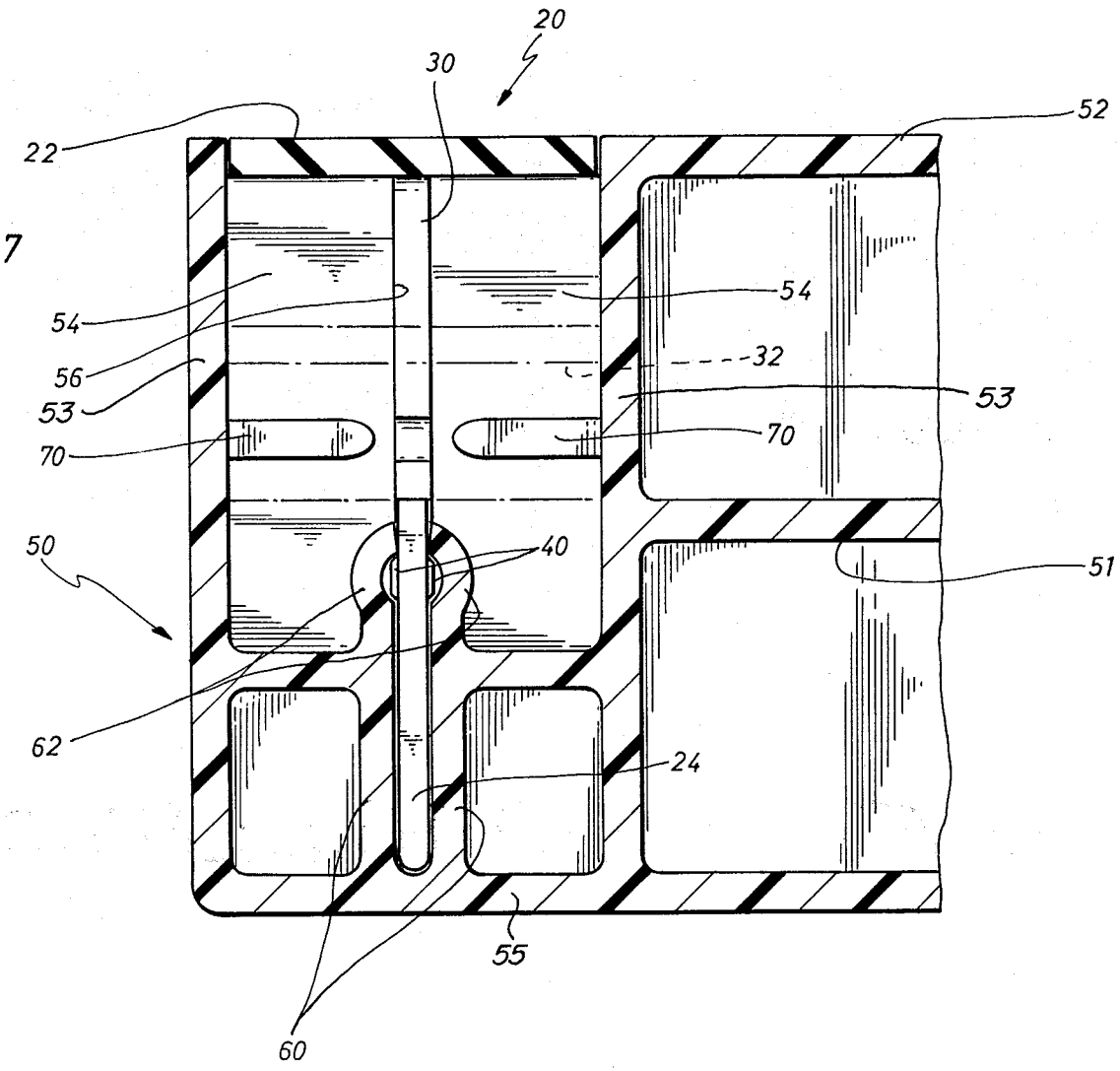
FIG. 7 is a cross-sectional view illustrating the interconnecting area of two interconnected stringers.

Stringers 20 and 50 are interconnected by means of an attaching and interconnecting means as illustrated in detail in FIG. 5. Each interconnecting area in stringers 20 includes a pair of generally parallel sides 23, a third side 22 interconnecting the sides 23 and a member receiving slot 26 placed in an interconnecting web member 24. In the preferred embodiment slot 26 extends at least half the length of web 24 in the direction of the axis of the slot and is just wide enough to receive therein web portion 58 of stringer 50. Web portion 58 is that portion of member 54 between surfaces 60. Similarly, each interconnecting area of stringer 50 includes a pair of generally parallel sides 53, a third side 55 interconnecting the sides and a corresponding slot 56 which in the preferred embodiment likewise extends at least half the length of web 54 in the direction of the axis of the slot. Slot 56 has a width essentially equal to the thickness of web portion 28 of stringer 20. Web portion 28 is that portion of member 24 between surfaces 30. As shown in FIG. 7, the dimension between the two sides 23, and correspondingly between the two sides 53, is at least slightly larger than the width of the third sides 23 and 55, to accommodate the third side of the other member fitting between the two sides when the two members are interlocked.

When stringers 20 and 50 are brought together, surfaces 22 and 52 form a flat supporting surface.

Each interconnecting web area 24 and 54 of stringers 20 and 50 contains two or more nipples or ridges 40 and 70. In the preferred embodiment each interconnecting area contains four such ridges 40 and four such ridges 70. These ridges are raised areas extending along members 24 and 54 perpendicular to slots 26 and 56. As an alternative, these ridges may be replaced with similarly located nipples, i.e. semispherical projections. In the preferred embodiment, such ridges 40 and 70 are located with two such ridges on each face of members 24 and 54 (see FIG. 7), one ridge on each side of slot 26 and 56. Alternatively, there may be fewer than four such ridges 40 and 70 at each interconnecting area of each stringer, for example there may be only one nipple on each face of the respective members 24 and 54. These nipples or ridges 40 and 70 should be located so as always to be on either the left or the right of slots 26 and 56 when members 24 and 54 are viewed from the side with the support surfaces 22 and 52 on top.

Stringers 20 and 50 also contain guidelock supports 30 and 60 which, in the preferred embodiment, extend to the width of stringers 20 and 50. Each set of guidelock supports 30 and 60 is separated by the thickness of web members 54 and 24 respectively, is placed along web portions 28 and 58 is generally perpendicular to the webs 24 and 58, with each wall of the guidelock support being positioned on each side of the axis of the corresponding slot. When stringers 20 and 50 are brought together webs 54 are guided between guidelock supports 30, while webs 24 are similarly guided between guidelock supports 60. In the preferred embodiment each interconnecting area of each of stringers 20 and 50 contains four guidelock supports 30 and 60. These guidelock supports are placed two on each side of members 24 and 54 and one on each side of web portions 28 and 58. Alternatively, there may be fewer than four such surfaces 30 and 60 at each interconnecting area of each stringer, in which case surfaces 30 and 60 should be located similarly to the locations of ridges 40 and 70. For example, one such lock surface may be provided on each face of each respective web member, but two are preferred for structural rigidity and stabilization when the stringers are interconnected.

Each guide and lock surface 30 and 60 contains appropriately placed indents or ridge gripping detents 32 and 62, shaped and located to correspond to the nipples or ridges 40 and 70 described above. When stringers 20 and 50 are brought together, each indent or ridge gripping detent 32 will firmly snap over a respective nipple or ridge 70. Similarly, each nipple or ridge 40 will firmly snap into a respective indent or ridge gripping detent 62.

This attaching and interconnecting means provides a secure, firm, and sturdy interconnection of stringers 20 and 50. Assembly may be entirely by hand or may be assisted by a simple rubber mallet.

When forming a pallet, additional stability, strength and surface support may be obtained by the use of optional, but preferable, slats 80. In the preferred embodiment slats 80 are constructed of polypropylene, although any other appropriate material exhibiting the appropriate impact and tensile strength characteristics to minimize breakage may be used. In the preferred embodiment four such slats 80 are attached across stringers 50.

Slats 80 may be attached to stringers 50 by any appropriate means. One such means includes the use of attaching guideposts 90 located within stringers 50. Guideposts 90 are provided with nipples or ridges 92 extending in the plane of the pallet. Guideposts 90 are located within a recessed area of stringer 50 of width and depth equal to that of the end of slat 80. Slats 80 contain corresponding attaching areas in the lower surface thereof. In the preferred embodiment the attaching means consists of two ridge gripping areas 102 separated by a distance 100 equal to the width of guidepost 90. When slat 80 is brought down over guidepost 90 in the recessed area of stringer 50, guidepost 90 fits within area 100 between grippers 102 which snap firmly over ridges 92. Slat 80 is thus firmly locked into place providing a smooth support surface defined by surfaces 22, 52 and 82.

The interconnecting means illustrated in FIG. 5 may be used for attaching any two stringers or members. Stringers connected by the interconnecting means of the present invention may be used in many other applications. Such uses might include connection of stringers to provide edging for flower beds, gardens, store walkways, golf cart paths, etc.

The prefered embodiment of the invention employs this interconnecting means to produce a knock-down pallet for replacement of conventional wooden pallets. Such a pallet provides four-way entry, is lightweight and durable, and is easily constructed or repaired. A frame constructed similar to the known-down pallet of the preferred embodiment may be used for retaining walls for landscaping, patio floor construction, central air conditioning unit bases, small boat decks, or floors and bases for small utility buildings and many other uses.

The foregoing description of the invention has been directed in primary part to a particular preferred embodiment in accordance with the requirements of the Patent Statutes and for purposes of explanation and illustration. It will be apparent, however, to those skilled in the art that many modifications and changes in this specific apparatus may be made without departing from the scope and spirit of the invention. For example, the placement of the member receiving slots, ridges and ridge gripping detents may be altered while still maintaining the true spirit of the interconnecting means. Further, the interlocking means between the slats and stringers 50 might be modified as desired. Other uses and modifications of the present invention have been discussed above.

It is applicant's intention in the following claims to cover such modifications and variations as fall within the true spirit and scope of the invention.

What is claimed is:

1. A knock-down pallet, comprising:

(a) a plurality of first stringers, each having a support surface and a plurality of appropriately spaced attaching and interlocking areas, each attaching and interlocking area including:

(i) a generally planar web;

(ii) a slot projecting upwardly from a lower surface of said web toward the support surface, (iii) at least one ridge located on each side of said web at each attaching area, said ridge located to the side of the slot, and (iv) at least one guidelock support, the support including a pair of generally parallel walls extending outwardly away from and generally perpendicular to said web and located between the slot and support surface to receive a web of a second stringer, each wall of said guidelock support containing at least one indented ridge gripper, said ridge gripper corresponding to said ridge and placed so that when the receiving slots of a first stringer and a second stringer are brought together, said ridge gripper engages a ridge on a second stringer; and (b) a plurality of second stringers, each having a support surface and a plurality of appropriately spaced attaching and interlocking areas, each attaching and interlocking area including:

(i) a generally planar web;

(ii) a slot projecting downwardly from a top surface thereof, (iii) at least one ridge located on each side of said web to the side of said slot, and (iv) at least one guidelock support, the support including a pair of generally parallel walls extennding outwardly away from and generally perpendicular to said web and located below said slot to receive the web of a first stringer, each wall of said guidelock support containing at least one indented ridge gripper corresponding to said ridge and placed so that when the receiving slots of a second stringer and a first stringer are brought together, a ridge gripper of a second stringer engages a ridge on a first stringer.

2. The knock-down pallet of claim 1, wherein said ridges and guidelock supports are located on the same side of said slots in both first and second stringers when said support surfaces are in their proper position.

3. The knock-down pallet of claim 1, wherein there are at least four ridges and corresponding ridge grippers associated with each receiving slot in each of said first and said second stringers, located so that at least one ridge and corresponding ridge gripper are located on each side of each receiving slot.

4. The knock-down pallet of claim 1, wherein the slots extend at least half the length of said webs in the direction along the slots.

5. The knock-down pallet of claim 1, wherein each of said first and second stringers further comprises appropriately spaced recesses on openings in the underside or body thereof to receive therein the lift arms of a forklift vehicle.

6. The pallet as defined in claim 1, characterized by said second stringers further comprising a plurality of appropriately-spaced interlock areas for snapping into a plurality of support slats and a plurality of support slats, each of said slats having a support surface and appropriately-spaced interlock areas to snap into corresponding areas in said second stringers.

7. The knock-down pallet of claim 6, wherein said slats are attached to said second stringers by snap-together attaching means comprising:

an attaching guidepost containing at least one upraised ridge, and said attaching guidepost being below the support surface of said pallet; and a corresponding attaching area in the lower surface of said slats, said area comprising a ridge gripper to snap over the ridge on said support guide, so that the support surface of said slats lies in the plane of the support surface of said first and second stringers.

8. An interlock system for attaching and interlocking two members which each include a web in an interlocking region comprising:

(a) member receiving slots in the web of each member, (b) at least one nipple located on each side of each web and located out of alignment with the axis of each said slot, (c) a pair of support walls extending outwardly from at least one side of the web of each of said members, the support walls being spaced to receive the web of another member and being located on each side of the axis of the slot, an indent on each support wall and positioned so that when one member is inverted and the receiving slots of two members are brought together, said nipples snap into corresponding indents.

9. The interlock system of claim 8, wherein each member includes at least four nipples and corresponding indents, positioned so that at least one nipple and a corresponding indent are located on each side of said slot of each member.

10. The interlock system of claim 8, wherein said receiving slots extend at least half the length of said webs in the direction of the axis of the slot so that the attaching and interlocking areas of each of said members are identical and all of said members may be interchangeably interlocked with each other simply by inversion of one member with respect to another.

11. An interlock arrangement for attaching an interlocking two members, each member comprising:

an interlocking region including two generally parallel sides;

a web extending between and being generally perpendicular to the two generally parallel sides;

a slot extending through said web in a direction generally parallel to said two sides;

at least one raised interlocking ridge on each side of the web between the slot and one of said two sides; and at least one interlock in the arrangement, the interlock comprising a pair of spaced, generally parallel walls extending away from the web in a direction generally perpendicular to the web and parallel to said two sides such that the pair of walls will receive a portion of the web of another member, and an indent on each wall to fit over a raised interlocking ridge of another member.

12. The interlock arrangement as defined in claim 11, wherein a pair of raised interlocking ridges are on each side of the web positioned such that each ridge in the pair is on opposite sides of the slots; and an interlock on each side of the web.

13. The interlock arrangement of claim 12, wherein a third side is provided in the arrangement to extend between and interconnect corresponding ends of the two generally parallel sides, and the dimension between said two sides is at least slightly larger than the width of the third side, to accommodate the third side of another member fitting between the two sides when two members are interlocked.

14. A knock-down pallet, comprising:

(a) a plurality of first stringers, each having a support surface and a plurality of appropriately spaced attaching and interlocking areas, each attaching and interlocking area including:

(i) a slot projecting upwardly from the lower surface of said first stringer toward the support surface, (ii) at least one ridge located on each side of said first stringer at each attaching area, said ridge located adjacent and essentially perpendicular to said slot, and (iii) at least one guidelock support surface located on each side of said first stringer projecting outwardly from said first stringer and being adjacent and perpendicular to said slot, said guidelock support surface containing at least one indented ridge gripper, said ridge gripper corresponding to said ridge and placed so that when the receiving slots of a first stringer and a second stringer are brought together, said ridge gripper engages a ridge on a second stringer; and (b) a plurality of second stringers, each having a support surface and a plurality of appropriately spaced attaching and interlocking areas, each attaching and interlocking area including:

(i) a slot projecting downwardly from the top surface thereof, (ii) at least one ridge located on each side of said second stringer adjacent and essentially perpendicular to said slot therein, (iii) at least one guide surface located on each side of said second stringer projecting outwardly from said second stringer and being adjacent and perpendicular to said slot therein, said guidesurface containing at least one indented ridge gripper corresponding to said ridge and placed so that when the receiving slots of a second stringer and a first stringer are brought together, a ridge gripper of a second stringer engages a ridge on a first stringer, (iv) a plurality of spaced interlocked areas for receiving a plurality of support slats, (c) a plurality of support slats, each having a support area of support surface and spaced interlocked areas to snap into corresponding areas in the second stringers, and wherein the slats are attached to said second stringers by snap-together attaching means including an attaching guidepost containing at least one upraised ridge, said attaching guidepost being below the support surface of said pallet, and a corresponding attaching area in the lower surface of said slats, said area comprising a ridge gripper to snap over the ridge on said support guide, so that the support surface of said slats lies in the plane of the support surface of said first an second stringers.

* * * * *